US006789307B1

(12) United States Patent
Matz et al.

(10) Patent No.: US 6,789,307 B1
(45) Date of Patent: Sep. 14, 2004

(54) METHODS FOR ALIGNING AN ANTENNA WITH A SATELLITE

(75) Inventors: William R. Matz, Atlanta, GA (US); Timothy H. Weaver, Alpharetta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 281 days.

(21) Appl. No.: 10/014,284

(22) Filed: Dec. 11, 2001

Related U.S. Application Data

(62) Division of application No. 09/751,277, filed on Dec. 29, 2000.

(51) Int. Cl.[7] ..... H01P 11/00; H01Q 3/02

(52) U.S. Cl. ..... 29/600; 29/601; 342/359; 343/766; 343/765; 343/882

(58) Field of Search ..... 29/600, 601; 343/766, 343/758, 761, 882, 889, 765, 763; 248/282, 522; 342/359, 362, 363–366

(56) References Cited

U.S. PATENT DOCUMENTS

| | | | |
|---|---|---|---|
| 110,434 | A | 12/1870 | Clarke |
| 780,947 | A | 1/1905 | Grabe |
| 1,303,249 | A | 5/1919 | Brown |
| 1,522,751 | A | 1/1925 | Sechler |
| 1,935,246 | A | 11/1933 | Kirsch |
| 2,463,176 | A | 3/1949 | Hogrefe |
| 2,575,917 | A | 11/1951 | Johnson |
| 2,611,566 | A | 9/1952 | Landis |

(List continued on next page.)

FOREIGN PATENT DOCUMENTS

| | | |
|---|---|---|
| EP | 1 014 481 A1 | 6/2000 |
| WO | 00/24083 A1 | 4/2000 |

OTHER PUBLICATIONS

U.S. patent application Ser. No. 09/469,574, McDonald, filed Dec. 20, 1999.

U.S. patent application Ser. No. 10/008,424, Saunders et al., filed Nov. 13, 2001.

U.S. patent application Ser. No. 10/014,285, Matz et al., filed Dec. 11, 2001.

U.S. patent application Ser. No. 10/302,023, Matz et al., filed Nov. 11, 2002.

U.S. patent application Ser. No. 10/350,655, Watson, filed Jan. 24, 2003.

U.S. patent application Ser. No. 10/364,099, Matz et al., filed Feb. 11, 2003.

U.S. patent application Ser. No. 10/014,285, filed Dec. 11, 2001.

U.S. patent application Ser. No. 09/467,574, filed Dec. 20, 1999.

U.S. patent application Ser. No. 10/008,424, filed Nov. 13 2001.

U.S. patent application Ser. No. 10/302,023, filed Nov. 11, 2002.

U.S. patent application Ser. No. 10/350,655, filed Jan. 24, 2003.

U.S. patent application Ser. No. 10/364,099, filed Feb. 11, 2003.

*Primary Examiner*—Minh Trinh
(74) *Attorney, Agent, or Firm*—Kirkpatrick & Lockhart LLP

(57) ABSTRACT

Methods for aligning a satellite reflector with an antenna that has a feed/LNBF assembly. The feed/LNBF assembly is electronically coupled to a set top box which is electronically coupled to a television that has a television speaker. A transmitter is placed adjacent the television speaker. The speaker transmits the audio tones emitted by the television speaker which are indicative to the alignment of the antenna with a satellite to a speaker located adjacent to or attached to the antenna or antenna support structures.

15 Claims, 4 Drawing Sheets

U.S. PATENT DOCUMENTS 2,614,861 A 10/1952 Van Horn
2,667,317 A 1/1954 Trebules
2,754,156 A 7/1956 Elderkin
3,910,561 A 10/1975 Fomells
3,941,340 A 3/1976 Rankins
4,095,230 A 6/1978 Salmond et al.
4,126,865 A 11/1978 Longhurst et al.
4,237,465 A 12/1980 Shibano et al.
4,258,568 A 3/1981 Boetes et al.
4,495,706 A 1/1985 Kaminski
4,626,864 A 12/1986 Micklethwaite
4,691,207 A 9/1987 Timineri
4,726,259 A 2/1988 Idler
4,833,932 A 5/1989 Rogers
4,990,924 A 2/1991 McMullen et al.
5,065,969 A 11/1991 McLean
5,088,672 A 2/1992 Neuendorf et al.
5,138,651 A 8/1992 Sudo
5,276,972 A 1/1994 Staney
5,351,060 A 9/1994 Bayne
5,376,941 A 12/1994 Fukazawa et al.
5,463,403 A 10/1995 Walker et al.
5,469,182 A 11/1995 Chaffee
5,473,335 A 12/1995 Tines
5,561,433 A 10/1996 Chaney et al.
5,589,837 A 12/1996 Soleimani et al.
5,621,418 A 4/1997 Maloney
5,646,638 A 7/1997 Winegard et al.
5,647,134 A 7/1997 Chou
5,657,031 A 8/1997 Anderson et al.
5,664,752 A 9/1997 Matthiessen et al.
5,734,356 A 3/1998 Anderson et al.
5,760,739 A 6/1998 Pauli
5,764,186 A 6/1998 Yoo
5,829,121 A 11/1998 Shoemaker et al.
5,870,059 A 2/1999 Reynolds
5,884,199 A 3/1999 Maki
5,894,674 A 4/1999 Feldman
5,903,237 A 5/1999 Crosby et al.
5,915,020 A 6/1999 Tilford et al.
5,920,291 A 7/1999 Bosley
5,923,288 A 7/1999 Pedlow, Jr.
5,933,123 A 8/1999 Kaul
5,940,028 A 8/1999 Iwamura
5,945,945 A 8/1999 Wagner et al.
D413,603 S 9/1999 Inoue
5,977,922 A 11/1999 Hemmingsen, II
5,992,809 A 11/1999 Sweere et al.
5,999,139 A 12/1999 Benjamin et al.
6,008,769 A 12/1999 Palmiter et al.
6,011,511 A 1/2000 Chuong et al.
6,023,247 A 2/2000 Rodeffer
6,031,508 A 2/2000 Ishizuka et al.
6,037,913 A 3/2000 Johnson
6,188,372 B1 2/2001 Jackson et al.
6,208,314 B1 3/2001 Bourquin
6,216,266 B1 4/2001 Eastman et al.
6,229,480 B1 5/2001 Shintani
6,262,687 B1 7/2001 Bai et al.
6,285,338 B1 9/2001 Bai et al.
6,331,839 B1 12/2001 Grenell
D453,151 S 1/2002 Weaver
6,337,658 B1 1/2002 Tong et al.
D453,330 S 2/2002 Weaver
6,480,161 B2 11/2002 Watson
6,484,987 B2 11/2002 Weaver
6,486,851 B2 11/2002 Weaver
6,507,325 B2 1/2003 Matz et al.
6,559,806 B1 5/2003 Watson
6,580,391 B1 * 6/2003 Kepley et al. ..... 342/359
6,683,581 B2 1/2004 Matz et al.
2002/0083573 A1 7/2002 Matz et al.
2002/0083574 A1 7/2002 Matz et al.
2002/0084941 A1 7/2002 Matz et al.
2002/0084946 A1 7/2002 Matz et al.

* cited by examiner

METHODS FOR ALIGNING AN ANTENNA WITH A SATELLITE

CROSS-REFERENCE TO RELATED APPLICATIONS

This is a divisional application of U.S. patent application Ser. No. 09/751,277, filed Dec. 29, 2000.

FEDERALLY SPONSORED RESEARCH

Not applicable.

BACKGROUND OF THE INVENTION

1. Field of the Invention

The subject invention relates to alignment devices and methods and, more particularly, to devices and methods for aligning an antenna with a satellite.

2. Description of the Invention Background

The advent of the television can be traced as far back to the end of the nineteenth century and beginning of the twentieth century. However, it wasn't until 1923 and 1924, when Vladimir Kosma Zworykin invented the iconoscope, a device that permitted pictures to be electronically broken down into hundreds of thousands of components for transmission, and the kinescope, a television signal receiver, did the concept of television become a reality. Zworykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted via terrestrial broadcast networks and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite.alignment methods and apparatuses will be required.

Modern digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or are mounted to a tree or mast located in the subscriber's yard. A typical antenna constructed to receive satellite signals comprises a dish-shaped reflector that has a support arm protruding outward from the front surface of the reflector. The support arm supports a low noise block amplifier with an integrated feed "LNBF". The reflector collects and focuses the satellite signal onto the LNBF which is connected, via cable, to the subscriber's television.

To obtain an optimum signal, the antenna must be installed such that the centerline axis of the reflector, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed. Also, as the satellite orbits the earth, it may be so oriented such that it sends a signal that is somewhat skewed. To obtain an optimum signal, the antenna must also be adjustable to compensate for a skewed satellite orientation.

The ability to quickly and accurately align the centerline axis of antenna with a satellite is somewhat dependent upon the type of mounting arrangement employed to support the antenna. Prior antenna mounting arrangements typically comprise a mounting bracket that is directly affixed to the rear surface of the reflector. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation. These adjustments are typically made at the mounting bracket.

One method that has been employed in the past for indicating when the antenna has been positioned at a proper azimuth orientation is the use of a compass that is manually supported by the installer under the antenna's support arm. When using this approach however, the installer often has difficulty elevating the reflector to the proper elevation so that the antenna will be properly aligned and then retaining the antenna in that position while the appropriate bolts and screws have been tightened. The device disclosed in U.S. Pat. No. 5,977,922 purports to solve that problem by affixing a device to the support arm that includes a compass and an inclinometer. In this device, the support arm can move slightly relative to the reflector and any such movement or misalignment can contribute to pointing error. Furthermore, devices that are affixed to the support arm are not as easily visible to the installer during the pointing process. In addition, there are many different types and shapes of support arms which can require several different adapters to be available to the installer. It will also be understood that the use of intermediate adapters could contribute pointing error if they do not interface properly with the support arm.

Another method that has been used in the past to align the antenna with a satellite involves the use of a "set top" box that is placed on or adjacent to the television to which the antenna is attached. A cable is connected between the set top box and the antenna. The installer initially points the antenna in the general direction of the satellite, then fine-tunes the alignment by using a signal strength meter displayed on the television screen by the set top box. The antenna is adjusted until the onscreen meter indicates that signal strength and quality have been maximized. In addition to the onscreen display meter, many set top boxes emit a repeating tone. As the quality of the signal improves, the frequency of the tones increases. Because the antenna is located outside of the building in which the television is located, such installation method typically requires two individuals to properly align the antenna. One installer positions the antenna while the other installer monitors the onscreen meter and the emitted tones. One individual can also employ this method, but that person typically must make multiple trips between the antenna and the television until the antenna is properly positioned. Thus, such alignment methods are costly and time consuming.

In an effort to improve upon this shortcoming, some satellite antennas have been provided with a light emitting diode ("LED") that operates from feedback signals fed to the antenna by the set top box through the link cable. The LED flashes to inform the installer that the antenna has been properly positioned. It has been noted, however, that the user is often unable to discern small changes in the flash rate of the LED as antenna is positioned. Thus, such approach may result in antenna being positioned in an orientation that results in less than optimum signal quality. Also, this approach only works when the antenna is relative close to its correct position. It cannot be effectively used to initially position the antenna. U.S. Pat. No. 5,903,237 discloses a microprocessor-operated antenna pointing aid that purports to solve the problems associated with using an LED indicator to properly orient the antenna.

Such prior antenna mounting devices and methods do not offer a relatively high amount of alignment precision. Furthermore, they typically require two or more installers to complete the installation and alignment procedures. As additional satellites are sent into space, the precision at which an antenna is aligned with a particular satellite becomes more important to ensure that the antenna is receiving the proper satellite signal and that the quality of that signal has been optimized. It is also desirable to have an antenna alignment device that can be effectively used by one installer.

There is a need for a method for aligning an antenna with a satellite that can be employed in connection with a set top box and that can be quickly, accurately, and efficiently employed by one installer.

SUMMARY OF THE INVENTION

In accordance with one form of the present invention, there is provided a method of aligning an antenna having a feed/LNBF assembly with a satellite. One version of the method includes electronically coupling a set top box to a television having a television speaker and electronically coupling the feed/LNBF assembly of the antenna to the set top box. Thereafter, the set top box and television are operated such that a series of tones are emitted from the television speaker which are indicative of the alignment of the antenna with the satellite. A speaker is supported adjacent to the antenna and a transmitter is supported adjacent to the television speaker. The transmitter transmits the series of tones emitted by the television speaker to the speaker.

It is a feature of the present invention to provide methods for quickly and efficiently aligning an antenna with a satellite such that the antenna receives and optimal signal from the satellite.

It is another feature of the present invention to provide methods having the above-mentioned attributes that can be efficiently used by one installer.

Accordingly, the present invention provides solutions to the shortcomings of prior methods for orienting antennas for receiving satellite signals. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
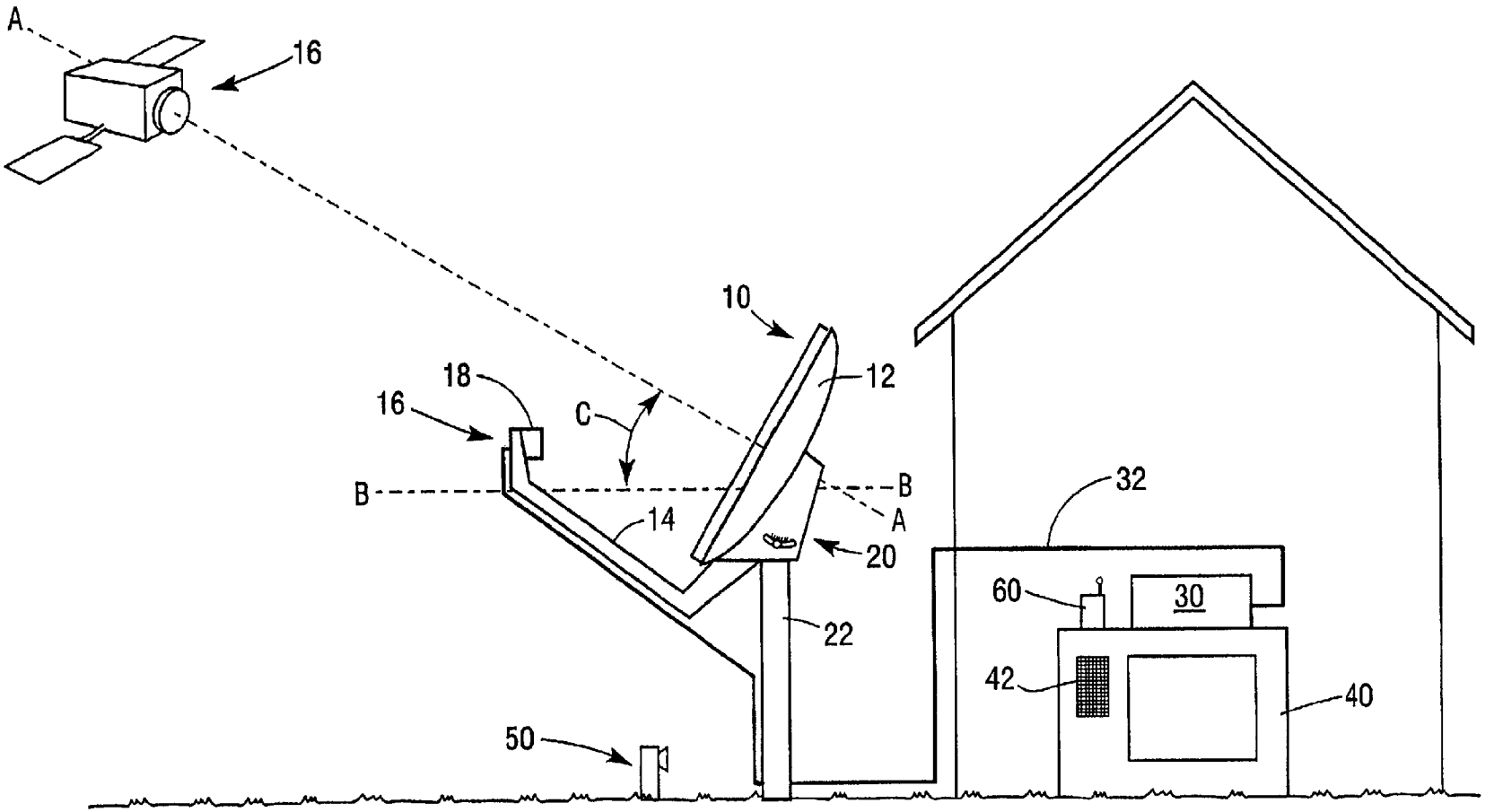
FIG. 1 is a graphical representation of an antenna that is electronically coupled to a set top box that is electronically coupled to a television.

Referring now to the drawings for the purposes of illustrating embodiments of the invention only and not for the purposes of limiting the same, FIG. 1 illustrates a conventional antenna 10 that is oriented to receive audio and video signals from a satellite 16 in geosynchronous orbit around the earth. The antenna 10 includes parabolic reflector 12 and an arm assembly 14 that includes a forwardly extending portion 16 that supports a feed/LNBF assembly 18 for collecting focused signals from the reflector 12. The antenna reflector 12 is affixed to a conventional mounting bracket 20 that is affixed to a vertically extending mounting mast 22 that is plumb with respect to the horizon. Various methods of installing the mast such that it is plumb are known in the art. Furthermore, such antennas and mounting bracket arrangements are known in the art. As the present Detailed Description proceeds, the skilled artisan will appreciate that the various embodiments of the present invention may be used with a myriad of different antenna configurations and mounting brackets, such as those described in co-pending U.S. patent application Ser. No. 09/751,460, filed Dec. 29, 2000, entitled MOUNTING BRACKET, the disclosure of which is herein incorporated by reference.

Figure 2:
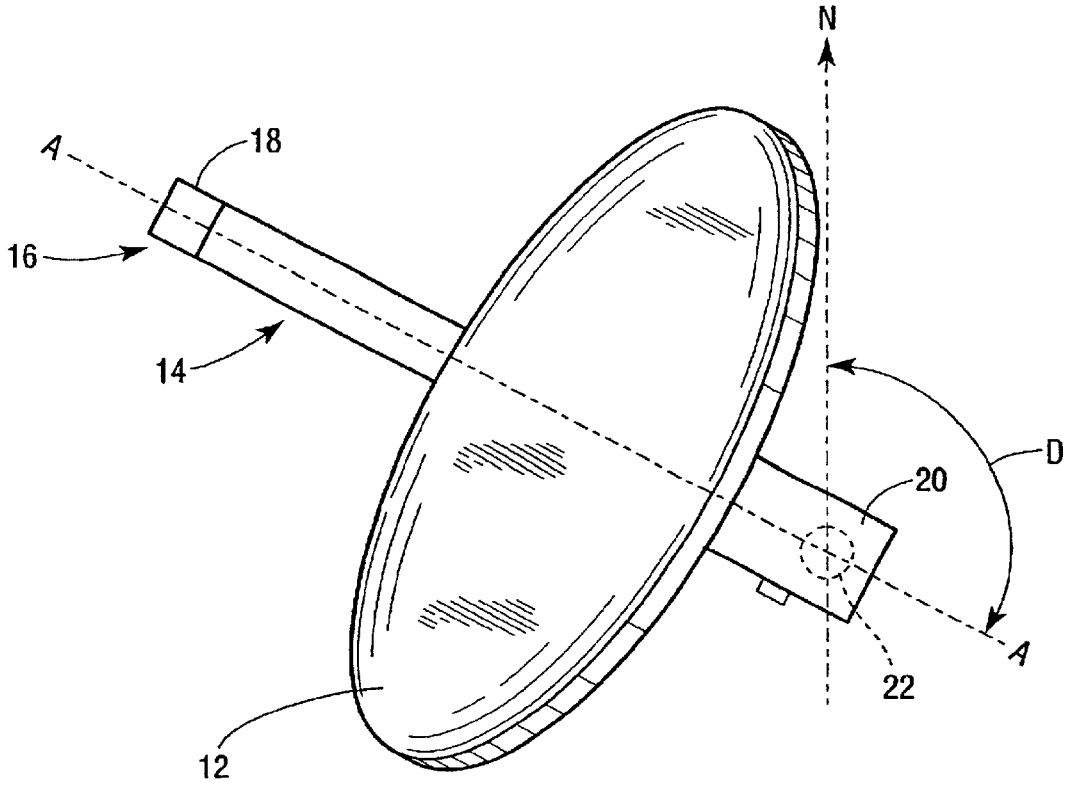
FIG. 2 is a plan view of the antenna depicted in FIG. 1.

Antenna 10 must be properly positioned to receive the television signals transmitted by the satellite 16 to provide optimal image and audible responses. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". The elevation is commonly adjusted by virtue of an elevation adjustment mechanism on the mounting bracket 14. The antenna's "azimuth" refers to the angle of axis A—A relative to the direction of true north in a horizontal plane. That angle is generally designated as angle "D" in FIG. 2. "Skew" refers to the angle of the reflector with respect to the centerline or borsite A—A.

The antenna 10 is "electronically coupled" to a satellite broadcast receiver ("set top box") 30 by coaxial cable 32.

The set top box 30 is electronically coupled to a television 40. Such set top boxes are known in the art and comprise an integrated receiver decoder for decoding the received broadcast signals from the antenna 10. During operation, the feed/LNBF assembly 18 converts the focused signals from the satellite 16 to an electrical current that is amplified and down converted in frequency. The amplified and down-converted signals are then conveyed via cable 32 to the set top box 30. The set top box 30 tunes the output signal to a carrier signal within a predetermined frequency range. A tuner/demodulator within the set top box 30 decodes the signal carrier into a digital data stream selected signal. Also a video/audio decoder is provided within the set top box 30 to decode the encrypted video signal. A conventional user interface on the television screen is employed to assist the installer of the antenna 10 during the final alignment and "pointing" of the antenna 10.

In common practice, one installer is positioned at the antenna 10 to carry out the actual adjustment of the antenna 10. Another installer is positioned to watch the onscreen output of the set top box and to listen to the audio output of the set top box. Those of ordinary skill in the art will appreciate that most set top boxes emit a repeating tone at a frequency that increases as the satellite signal improves until it becomes a single tone. The installer monitoring the set top box typically must make several trips between the set top box and the antenna to convey alignment instructions to the installer orienting the antenna. Or, if a single installer is employed to install the antenna, that individual typically must make several trips between the antenna and set top box until the antenna is positioned in final optimum orientation.

Figure 3:
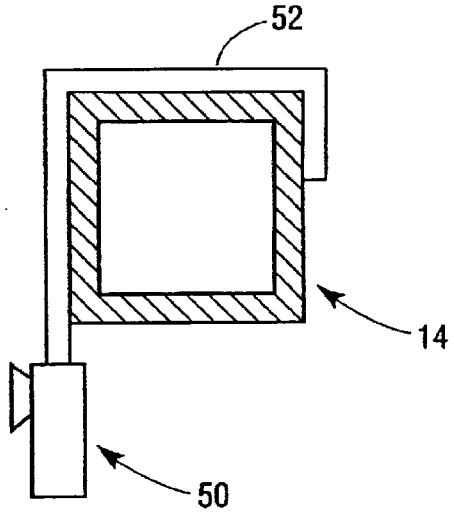
FIG. 3 is a cross-sectional view of a portion of the support arm of the antenna depicted in FIG. 2 with a speaker suspended therefrom.
Figure 4:
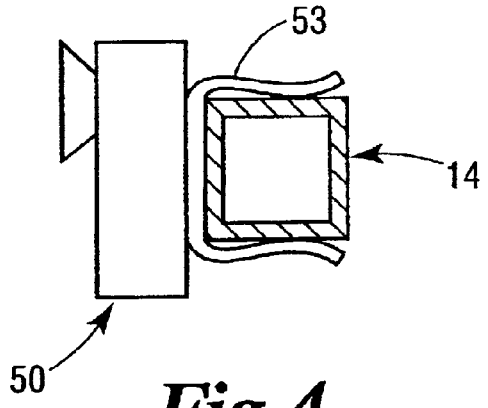
FIG. 4 is a cross-sectional view of a portion of the support arm of the antenna depicted in FIG. 2 with a speaker clamped thereto.
Figure 5:
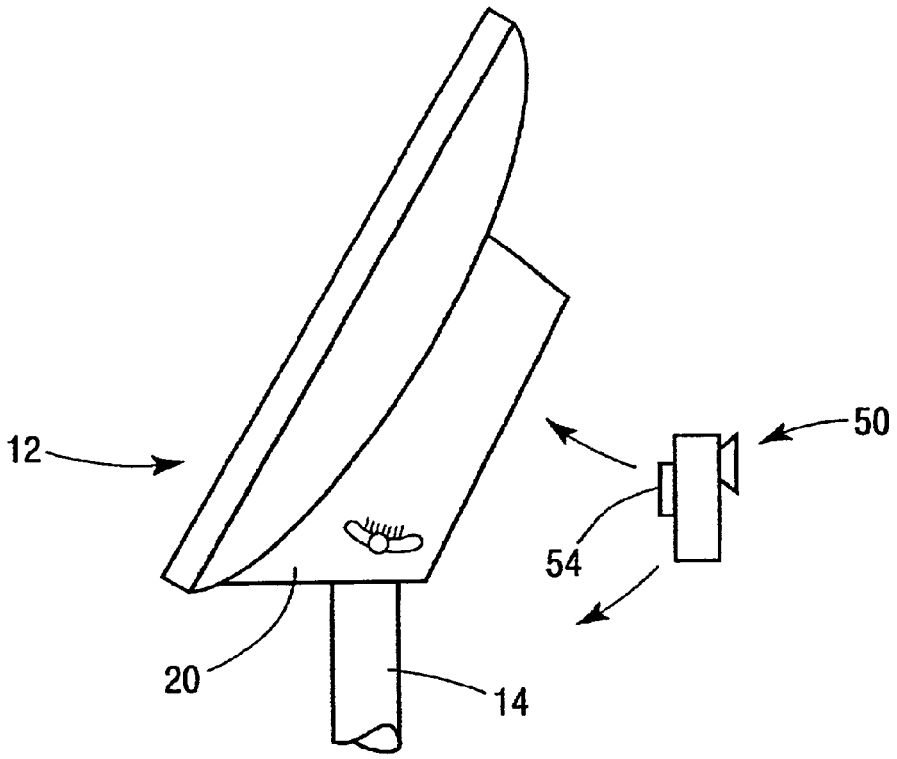
FIG. 5 is a side view of the antenna of FIG. 1 and a speaker equipped with a magnetic for attachment to the mounting bracket thereof or to the mounting mast.
Figure 6:
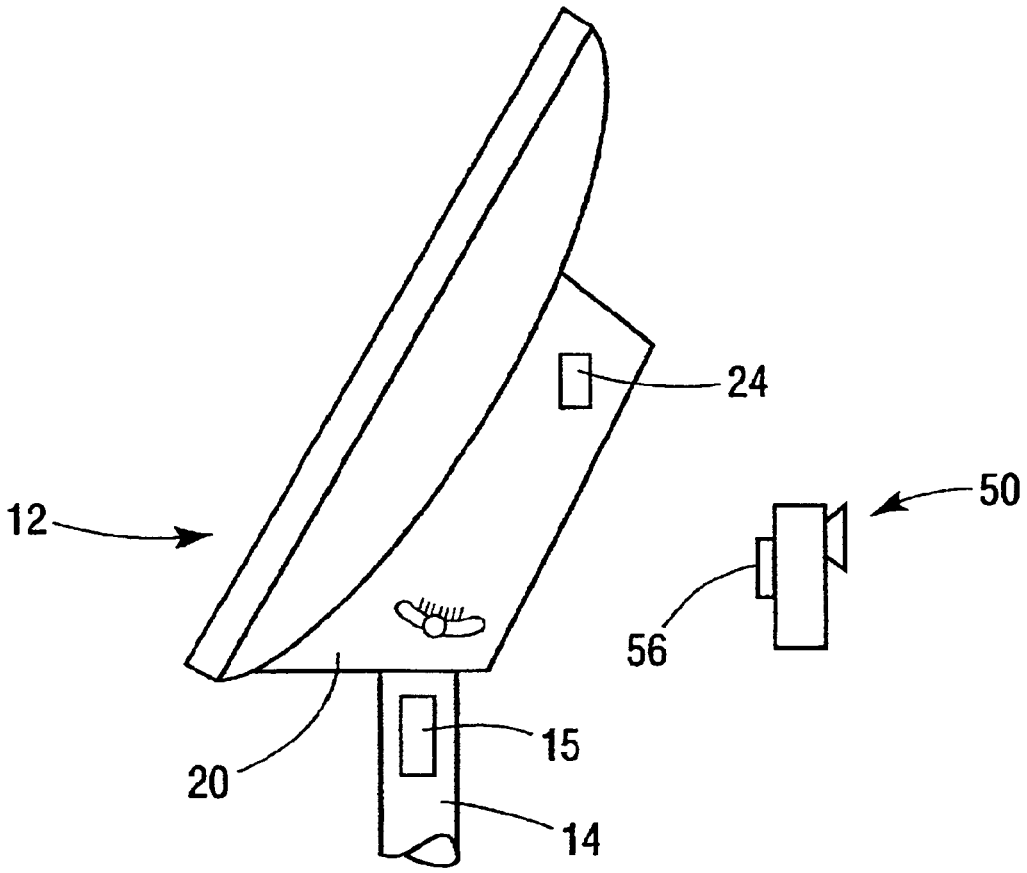
FIG. 6 is another side view of the antenna of FIG. 1 and a speaker equipped with hook and loop fastener material for attachment to hook and loop fastener material on the mounting bracket or to hook and loop material on the mounting mast.

The present invention is designed to eliminate the inefficiencies encountered when employing set top boxes for aligning antenna with a satellite. More particularly, one embodiment of the present invention comprises a speaker 50 and transmitter 60. Speaker 50 and transmitter 60 may comprise those commercially available speakers and transmitters that are often sold as one-way-short range radio infant monitoring devices. To use the speaker 50 and transmitter 60, the installer places the transmitter 60 adjacent to the television's audio speaker 42 such that it can receive and transmit the audio signals emitted during use of the set top box 60 to the speaker 50. The speaker 50 may be placed anywhere adjacent the antenna 10 in order that the installer may hear the audio output therefrom. For example, as shown in FIG. 1 the speaker unit 50 may be placed on the ground adjacent the antenna. As shown in FIG. 3, the speaker may be removably affixed to the support arm 14. As shown in FIG. 3, speaker 50 may be attached to the support arm by a hanger 52. As shown in FIG. 4, speaker 50 may be attached to the support arm 14 by a clamp 53. Likewise, speaker may have a magnet 54 affixed thereto to enable it to be magnetically attached to bracket 20 or mast 22. See FIG. 5. Those of ordinary skill in the art will appreciate that the magnet should be located and or shielded so as to not interfere with the operation of the compass. In the alternative, the speaker 50 may have hook and loop fasteners 56 for removably affixing the speaker to hook and loop fastener material 24 on the bracket 20 or to hook and loop fasteners 15 on the mast 22. See FIG. 6. Those of ordinary skill in the art will appreciate that the speaker may be supported by the antenna 10 in a variety of different manners. In the alternative, the installer may simply carry the speaker 50 on his or her person or attached to a belt, clothing or holster.

Regardless of how the speaker positioned or supported adjacent the antenna 10, the installer listens to audio signal emitted by the set top box and transmitted by the transmitter 60 to the speaker 50 and makes the necessary adjustments to the orientation of the antenna reflector 12 until the emitted audio signal indicates that the optimum orientation has been achieved. The antenna 10 is then retained in that position by locking the appropriate adjustment screws on the mounting bracket 20. Also, to make the transmitter 60 easy to locate and thus prevent it from becoming misplaced or lost during installation, it may be provided in a bright color, such a florescent orange, red, yellow, etc.

Thus, from the foregoing discussion, it is apparent that the present invention solves many of the problems encountered by prior antenna alignment devices and methods. In particular, the methods of the present invention are easy to employ and can be employed by one installer to quickly and accurately align an antenna with a satellite. Various methods of the present invention also include the use of a set top box to optimize the antenna's orientation without the need to make several trips between the antenna and the television to which the set top box is attached. Those of ordinary skill in the art will, of course, appreciate that various changes in the details which have been herein described and illustrated in order to explain the nature of the invention may be made by the skilled artisan within the principle and scope of the invention as expressed in the appended claims.

What is claimed is:

1. A method of aligning an antenna with a satellite, wherein the antenna has a centerline and a low noise block amplifier with an integrated feed that is electronically coupled to a set top box which is electronically coupled to a television having a television speaker therein, the method comprising:

receiving signals from the satellite through the low noise block amplifier with integrated feed;

amplifying and down converting the received satellite signals;

conveying the amplified and down converted signals to the set top box;

tuning the amplified and down converted signals such that the set top box causes a series of tones to be emitted from the television speaker which are indicative of the alignment of the antenna centerline with the satellite; and transmitting the series of tones to a speaker located adjacent the antenna.

2. The method of claim 1 wherein the transmitting comprises placing a transmitter adjacent the television speaker, the transmitter transmitting the series of tones to the speaker adjacent the antenna.

3. The method of claim 1 wherein the low noise block amplifier with an integrated feed is supported by a support arm and wherein the method further comprises supporting the speaker on the support arm.

4. The method of claim 3 wherein the supporting the speaker on the support arm comprises suspending the speaker from the support arm.

5. The method of claim 3 wherein the supporting the speaker on the support arm comprises clamping the speaker to the support arm.

6. The method of claim 1 wherein the speaker is placed on the ground adjacent the antenna.

7. The method of claim 1 wherein the antenna has mounting bracket attached thereto and wherein the method further comprises affixing the speaker to the mounting bracket.

8. The method of claim 7 wherein the affixing the speaker to the mounting bracket comprises magnetically attaching the speaker to the mounting bracket.

9. The method of claim 7 wherein the affixing the speaker to the mounting bracket comprises attaching the speaker to the mounting bracket with hook and loop fasteners.

10. The method of claim 7 wherein the affixing the speaker to the mounting bracket comprises suspending the speaker from the mounting bracket.

11. The method of claim 1 wherein the antenna is supported by a mast and wherein the method further comprises affixing the speaker to the mast.

12. The method of claim 11 wherein the affixing the speaker to the mast comprises magnetically attaching the speaker to the mast.

13. The method of claim 11 wherein the affixing the speaker to the mast comprises affixing the speaker to the mast with hook and loop fasteners.

14. A method of aligning an antenna having a centerline and a low noise block amplifier with an integrated feed with a satellite, said method comprising:

electronically coupling a set top box to a television having a television speaker;

electronically coupling the feed/LNBF assembly of the antenna to the set top box;

receiving signals from the satellite through the low noise block amplifier with integrated feed;

amplifying and down converting the received satellite signals;

conveying the amplified and down converted signals to the set stop box;

tuning the amplified and down converted signals such that the set top box causes a series of tones to be emitted from the television speaker which are indicative of the alignment of the antenna with the satellite;

supporting a speaker adjacent to the antenna; and supporting a transmitter adjacent the television speaker, the transmitter transmitting the series of tones emitted by the television speaker to the speaker.

15. An antenna installation method, comprising:

affixing an antenna having a low noise block amplifier with an integrated feed to a vertically extending mast;

electronically coupling a set top box to a television having a television speaker;

receiving signals from the satellite through the low noise block amplifier with integrated feed;

amplifying and down converting the received satellite signals;

conveying the amplified and down converted signals to the set stop box;

tuning the amplified and down converted signals such that the set top box causes a series of tones to be emitted from the television speaker which are indicative of the alignment of the antenna with the satellite;

affixing a speaker the vertically extending mast; and supporting a transmitter adjacent the television speaker, the transmitter transmitting the series of tones emitted by the television speaker to the speaker.

* * * * *